United States Patent [19]

Maier et al.

[11] 4,404,446

[45] Sep. 13, 1983

[54] STORED ENERGY CIRCUIT BREAKER WITH A CAM LATCH

[75] Inventors: Alfred E. Maier; Louis N. Ricci, both of Chippewa, Pa.

[73] Assignee: Westinghouse Electric Corp., Pittsburgh, Pa.

[21] Appl. No.: 324,298

[22] Filed: Nov. 23, 1981

[51] Int. Cl.[3] ..... H01H 9/20

[52] U.S. Cl. ..... 200/320; 200/153 SC; 200/318

[58] Field of Search ..... 200/153 SC, 318, 320, 200/321, 322, 324

[56] References Cited

U.S. PATENT DOCUMENTS

| | | | |
|---|---|---|---|
| 2,769,874 | 11/1956 | Coggeshall et al. | 335/76 |
| 2,820,119 | 1/1958 | Miller et al. | 335/76 |
| 3,845,263 | 7/1975 | Dickinson | 200/153 SC |
| 4,166,205 | 8/1979 | Maier et al. | 200/153 G |
| 4,301,435 | 11/1981 | Castowguay et al. | 200/153 SC X |
| 4,324,963 | 4/1982 | Maier et al. | 200/318 |

FOREIGN PATENT DOCUMENTS

| | | | |
|---|---|---|---|
| 2841821 | 7/1980 | Fed. Rep. of Germany | 200/153 SC |

*Primary Examiner*—Stephen Marcus
*Assistant Examiner*—Ernest G. Cusick
*Attorney, Agent, or Firm*—Michael S. Yatsko

[57] ABSTRACT

A circuit breaker is provided which includes stationary and movable contacts and a mechanism for moving the movable contact. A rotatable cam is included which has a cam pin fixedly secured thereto. The cam pin extends outwardly from the cam, and is contacted by releasable latch member which prevents the breaker from closing until the latch member is released.

5 Claims, 12 Drawing Figures

STORED ENERGY CIRCUIT BREAKER WITH A CAM LATCH

BACKGROUND OF THE INVENTION

This invention relates generally to single or multi-pole circuit breakers, and more particularly to stored energy circuit breakers.

The basic functions of circuit breakers are to provide electrical system protection and coordination whenever abnormalities occur on any part of the system. The operating voltage, continuous current, frequency, short circuit interrupting capability, and time-current coordination needed are some of the factors which must be considered when designing a breaker. Government and industry are placing increasing demands upon the electrical industry for interrupters with improved performance in a smaller package and with numerous new and novel features.

Stored energy mechanisms for use in circuit breakers of the single pole or multi-pole type have been known in the art. A particular construction of such mechanisms is primarily dependent upon the parameters such as a rating of the breaker. Needless to say, many stored energy circuit breakers having closing springs cannot be charged while the circuit breaker is in operation. For that reason, some circuit breakers have the disadvantage of not always being ready to close in a moment's notice. These circuit breakers do not have, for example, an open-close-open feature which users of the equipment find desirable.

SUMMARY OF THE INVENTION

In accordance with this invention, a circuit breaker is provided which includes stationary and movable contacts and a mechanism for moving the movable contact. A rotatable cam is included which has a cam pin fixedly secured thereto. The cam pin extends outwardly from the cam, and is contacted by releasable latch means which prevents the breaker from closing until the latch means is released.

BRIEF DESCRIPTION OF THE DRAWINGS

Reference is now made to the description of the preferred embodiment, illustrated in the accompanying drawings, in which.

DESCRIPTION OF THE PREFERRED EMBODIMENTS

Figure 1:
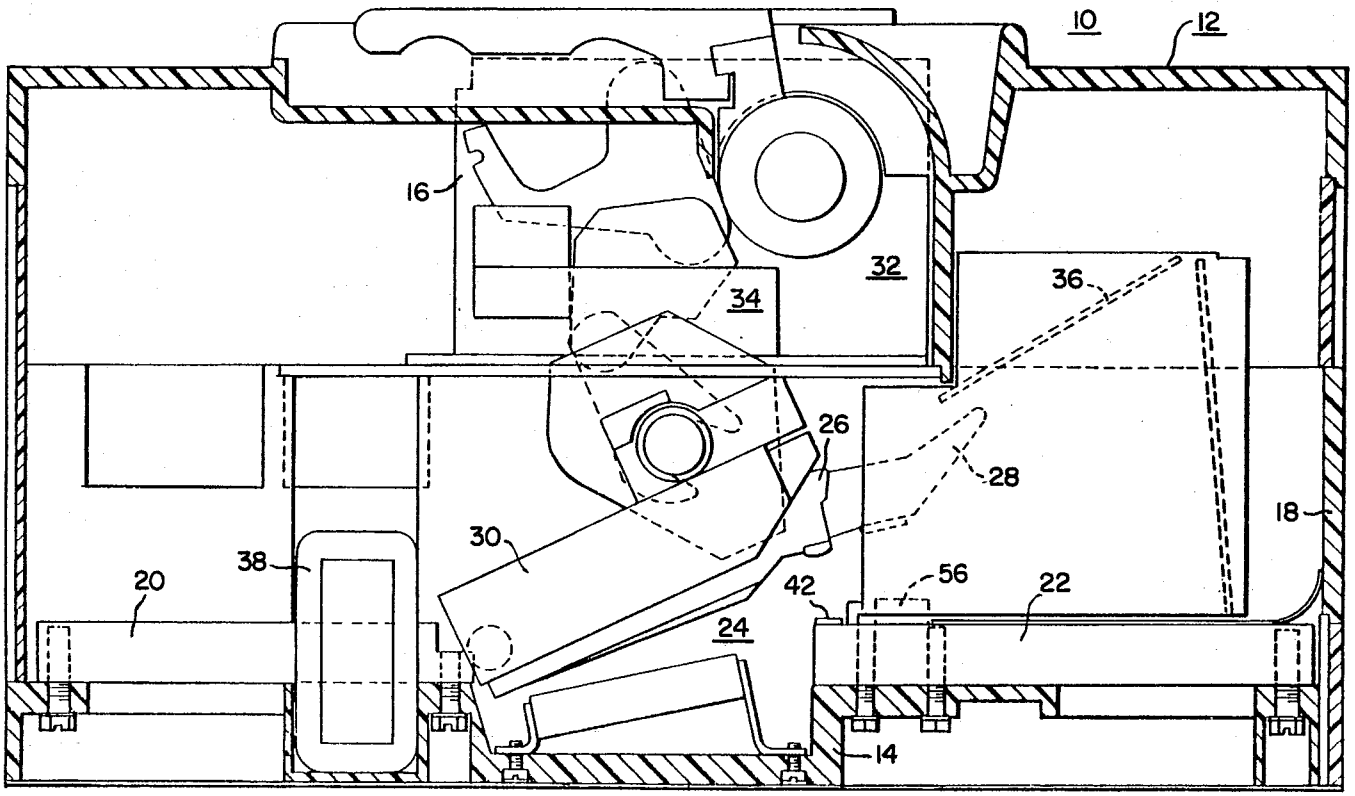
FIG. 1 is an elevational sectional view of a circuit breaker according to the teachings of this invention.

Referring now more particularly to FIG. 1, there is shown a circuit breaker utilizing the teachings of this invention. Although the description is made with reference to that type of circuit breaker known in the art as a molded case circuit breaker, it is to be understood that the invention is likewise applicable to circuit breakers generally. Except for the latch and trip device, the circuit breaker 10 is of the type disclosed in U.S. Pat. No. 4,166,205, issued Aug. 28, 1979 and which is incorporated herein by reference.

The circuit breaker 10 includes support 12 which is comprised of a mounting base 14, side walls 16, and a frame structure 18. A pair of stationary contacts 20, 22 are disposed within the support 12. Stationary contact 22 would, for example, be connected to an incoming power line (not shown), while the other stationary contact 20 would be connected to the load (not shown). Electrically connecting the two stationary contacts 20, 22 is a movable contact structure 24. The movable contact structure 24 comprises a movable contact 26, a movable arcing contact 28, a contact carrier 30 and contact holder 64. The movable contact 26 and the arcing contact 28 are pivotally secured to the stationary contact 20, and are capable of being in open and closed positions with respect to the stationary contact 22. Throughout this application, the term "open" as used with respect to the contact positions means that the movable contacts 26, 28 are spaced apart from the stationary contact 22, whereas the term "closed" indicates the position wherein the movable contacts 26, 28 are contacting both stationary contacts 22, 20. The movable contacts 26, 28 are mounted to, and carried by the contact carrier 30 and contact holder 64.

Also included within the circuit breaker 10 is an operating mechanism 32, a toggle means 34, and an arc chute 36 which extinguishes any arc which may be present when the movable contacts 26, 28 change from the closed to open position. A current transformer 38 is utilized to monitor the amount of current flowing through the stationary contact 20.

Figure 11:
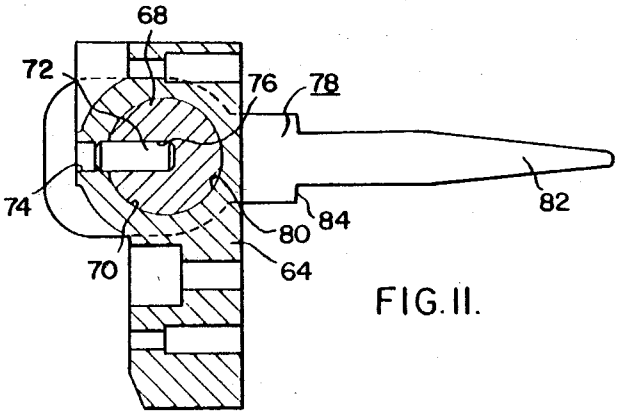
FIG. 11 is a side view of the cross arm structure.
Figure 10:
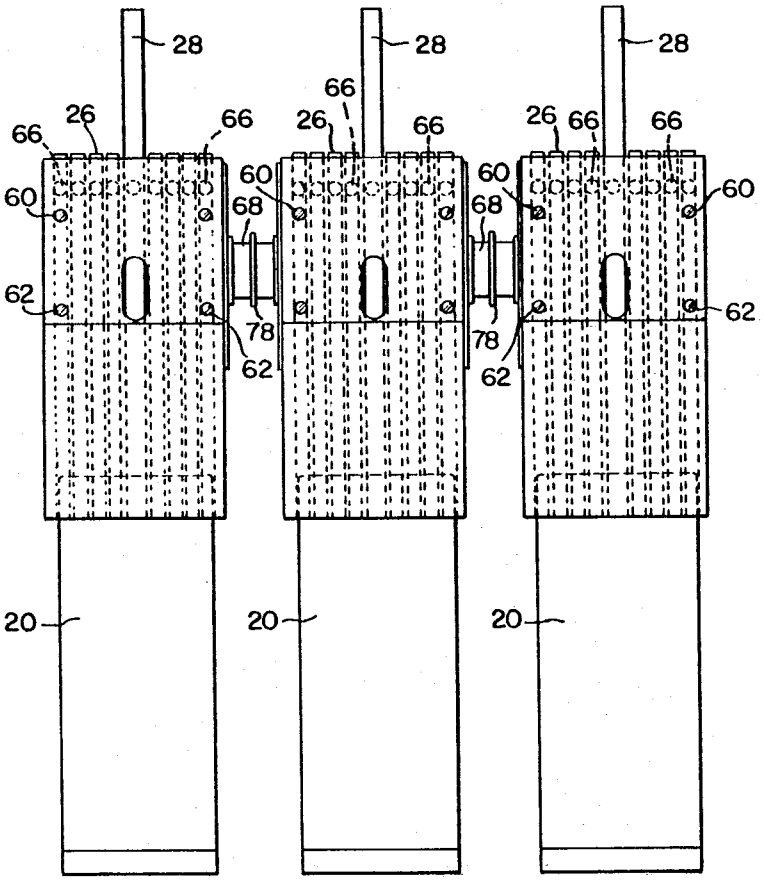
FIG. 10 is a plan view of a current carrying contact system.

Shown in FIG. 10 is a cross arm 68 which extends between the individual contact holder 64. The cross arm 68 assures that each of the three poles illustrated will move simultaneously upon movement of the operating mechanism 32 to drive the contacts 26, 28 into closed or open position. As shown in FIG. 11, the cross arm 68 extends within an opening 70 in the contact holder 64. A pin 72 extends through an opening 74 in the contact holder 64 and an opening 76 in the cross arm 68 to prevent the cross arm 68 from sliding out of the contact holder 64. Also attached to the cross arm 68 are pusher rods 78. The pusher rods 78 have an opening 80 therein, and the cross arm 68 extends through the pusher rod openings 80. The pusher rod 78 has a tapered end portion 82, and a shoulder portion 84. The pusher rod 78, and more particularly the tapered portion 82 extends into openings 86 within the breaker mounting base 14, (see FIG. 2) and disposed around the pusher rods 78 are springs 88. These springs 88 function to exert a force against the shoulder 84 of the pusher rod 78, thereby biasing the cross arm 68 and the movable contacts 26 in the open position. To close the movable contacts 26, it is necessary to move the cross arm 68 such that the pusher rods 78 will compress the spring 88. This movement is accomplished through the operating mechanism 32 and the toggle means 34.

Figure 2:
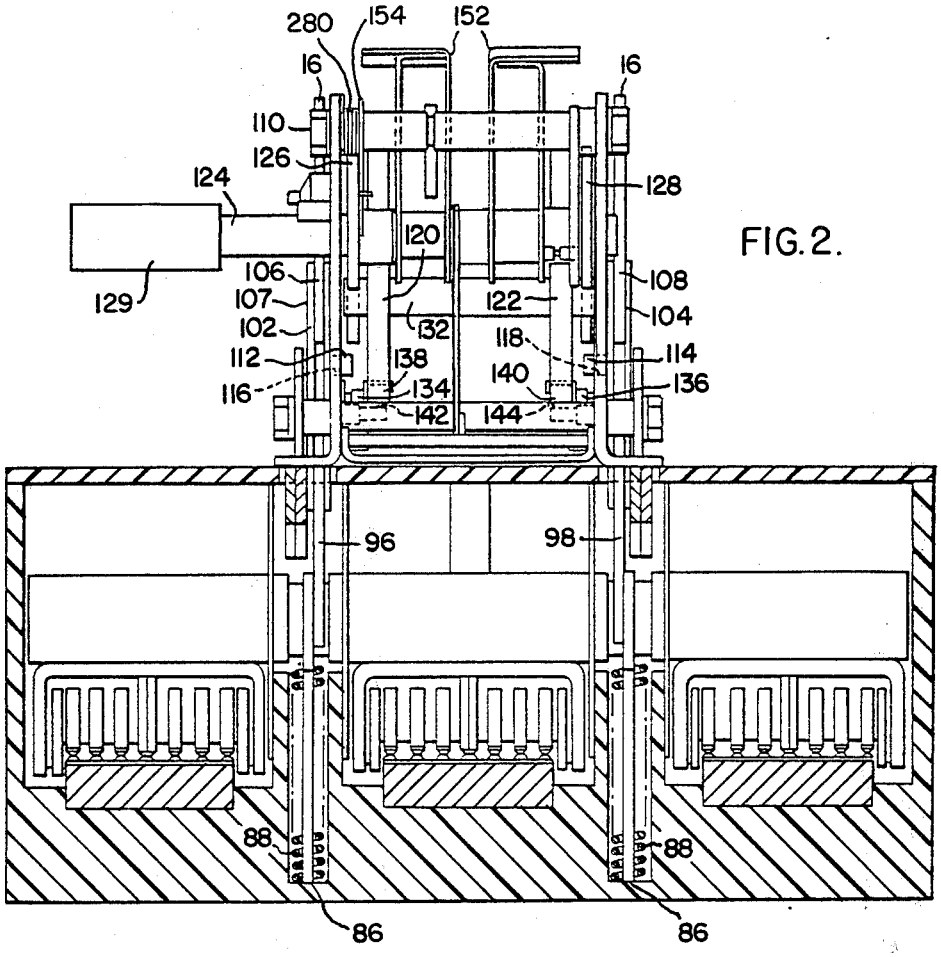
FIG. 2 is a cross-sectional view of the breaker of FIG. 1.
Figure 12:
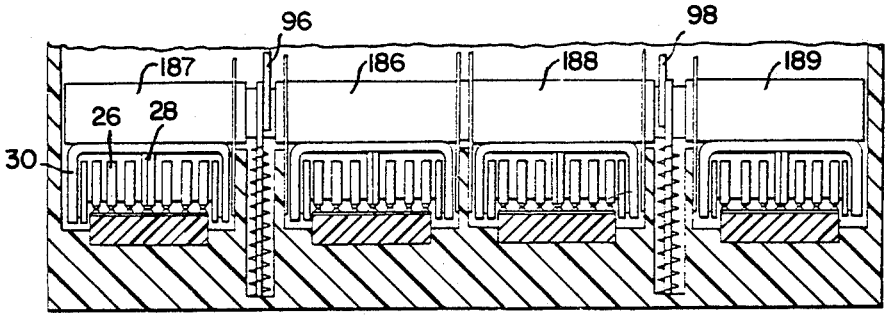
FIG. 12 is a modification of the multi-pole contact structure.
Figure 3:
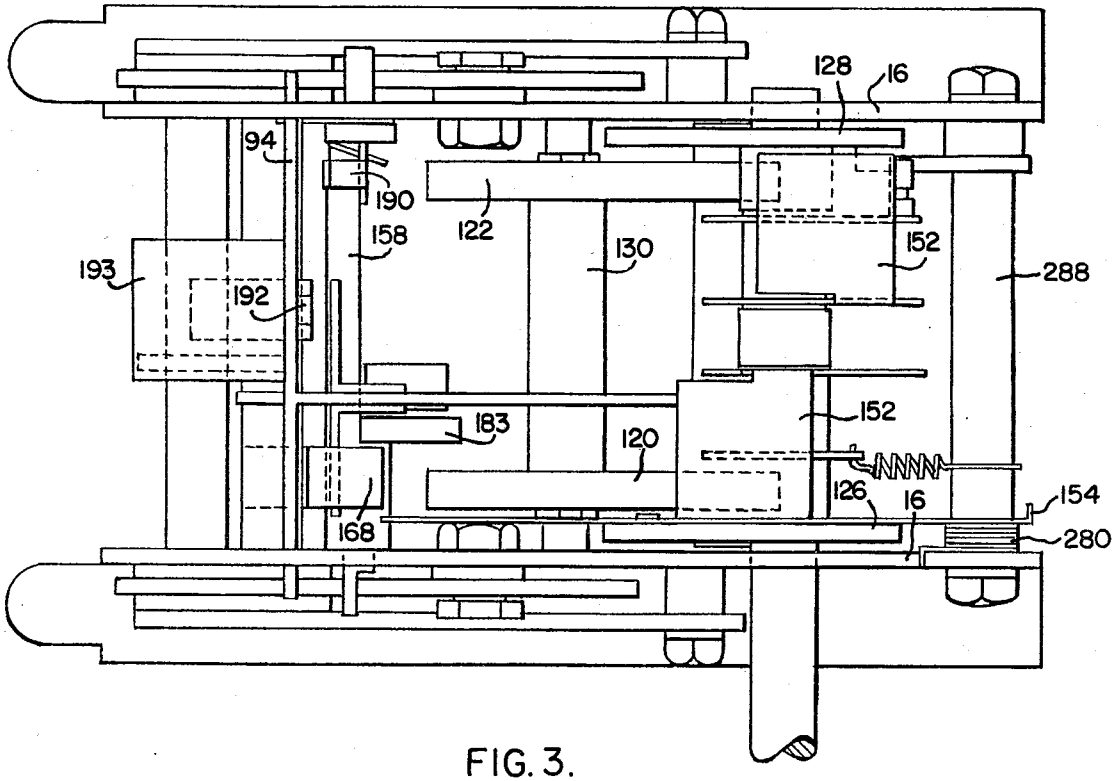
FIG. 3 is a plan view of the mechanism illustrated in FIG. 1.
Figure 4:
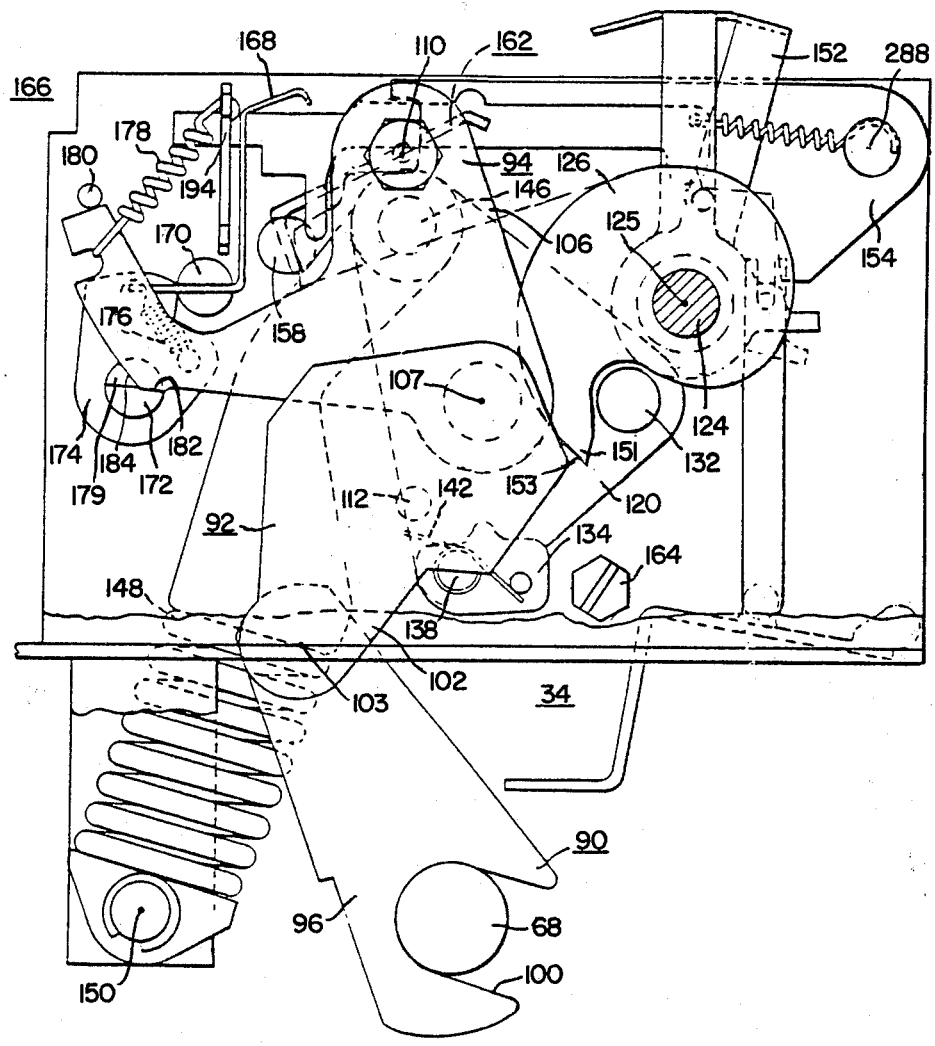
FIG. 4 is a detailed sectional view of the operating mechanism of the circuit breaker in the spring discharged, contact open position.

Referring now to FIGS. 2—4, there is shown the toggle means 34 and the operating mechanism 32. The toggle means 34 comprise a first link 90, a second link 92, and a toggle lever 94. The first link 90 is comprised of a pair of spaced-apart first link elements 96, 98, each of which have a slot 100 therein. The first link elements 96, 98, and the slot 100 engage the cross arm 68 intermediate the three contact holders 64, and provide movement of the cross arm 68 upon the link 90 going into toggle position. The location of the link elements 96, 98 intermediate the contact holders 64 reduces any deflection of the cross arm 68 under high short circuit forces. Also, the use of slot 100 to connect to the cross arm 68 provides for easy removal of the operating mechanism 32 from the cross arm 68. Although described with respect to the three-pole breaker illustrated in FIG. 2, it is to be understood that this description is likewise applicable to the four-pole breaker illustrated in FIG. 12. With this four-pole breaker, the first link elements 96, 98 are disposed between the interior contact holders 186, 188 and the exterior holders 187, 189.

The second link 92 comprises a pair of spaced-apart second link elements 102, 104 which are pivotally connected to the first link elements 96, 98 respectively at pivot point 103. The toggle lever 94 is comprised of a pair of spaced-apart toggle lever elements 106, 108 which are pivotally connected to the second link elements 102, 104 at pivot point 107, and the toggle lever elements 106, 108 are also pivotally connected to side walls 16 at pivotal connection 110. Fixedly secured to the second link elements 102, 104 are aligned drive pins 112, 114. The drive pins 112, 114 extend through aligned openings 116, 118 in the side walls 16 adjacent to the follower plates 120, 122.

The operating mechanism 32 is comprised of a drive shaft 124 rotatable about its axis 125 having a pair of spaced apart aligned cams 126, 128 secured thereto. The cams 126, 128 are rotatable with the drive shaft 124 and are shaped to provide a constant load on the turning means 129. Turning means, such as the handle 129 may be secured to the drive shaft 124 to impart rotation thereto. The operating mechanism 32 also includes follower plates 120, 122 which are fixedly secured together by the follower plate connector 130 (see FIG. 3). Fixedly secured to the follower plates 120, 122 is a cam roller 132. Also secured to each follower plate 120, 122 is a drive pawl 134, 136, respectively, which is positioned adjacent to the drive pins 112, 114. The drive pawls 134, 136 are pivotally secured to the follower plates 120, 122 by pins 138, 140, and are biased by the springs 142, 144.

The cam 126 has an inwardly-extending pin 282 fixedly secured thereto used for the latching and resetting function, as will hereinafter be described. The cam 126 also has a flat, angled latching surface 153 at the cam's largest diameter area. This latching surface 153 functions to hold the cam roller 132 in the charged position. Also used for the latching and tripping functioning of the breaker 10 is the latch member or latch lever 154. The latch member 154 is pivotally mounted on the connecting rod 288 (see FIG. 3) and is biased for movement in the clockwise direction by the spring 160.

The follower plates 122, 120 are also connected by a connecting bar 146 which extends between the two follower plates 120, 122, and pivotally connected to the connecting bar 146 are spring means 148. Spring means 148 is also pivotally connected to the support 12 by connecting rod 150. If desired, indicating apparatus 152 (see FIG. 2) may be incorporated within the breaker 10 to display the positions of the contacts 26, 28 and the spring means 148.

The operation of the circuit breaker can be best understood with reference to FIGS. 3–9. FIGS. 4–9 illustrate, in sequence, the movement of the various components as the circuit breaker 10 changes position from spring discharged, contact open, to spring charged, contact closed positions. In FIG. 4, the spring 148 is discharged, and the movable contact 26 is in the open position. Although the contacts 20, 22, and 26, 28 are not illustrated in FIGS. 4–9, the cross arm 68 to which they are connected is illustrated, and it is to be understood that the position of the cross arm 68 indicates the position of the movable contact 26 with respect to the stationary contact 22.

Figure 5:
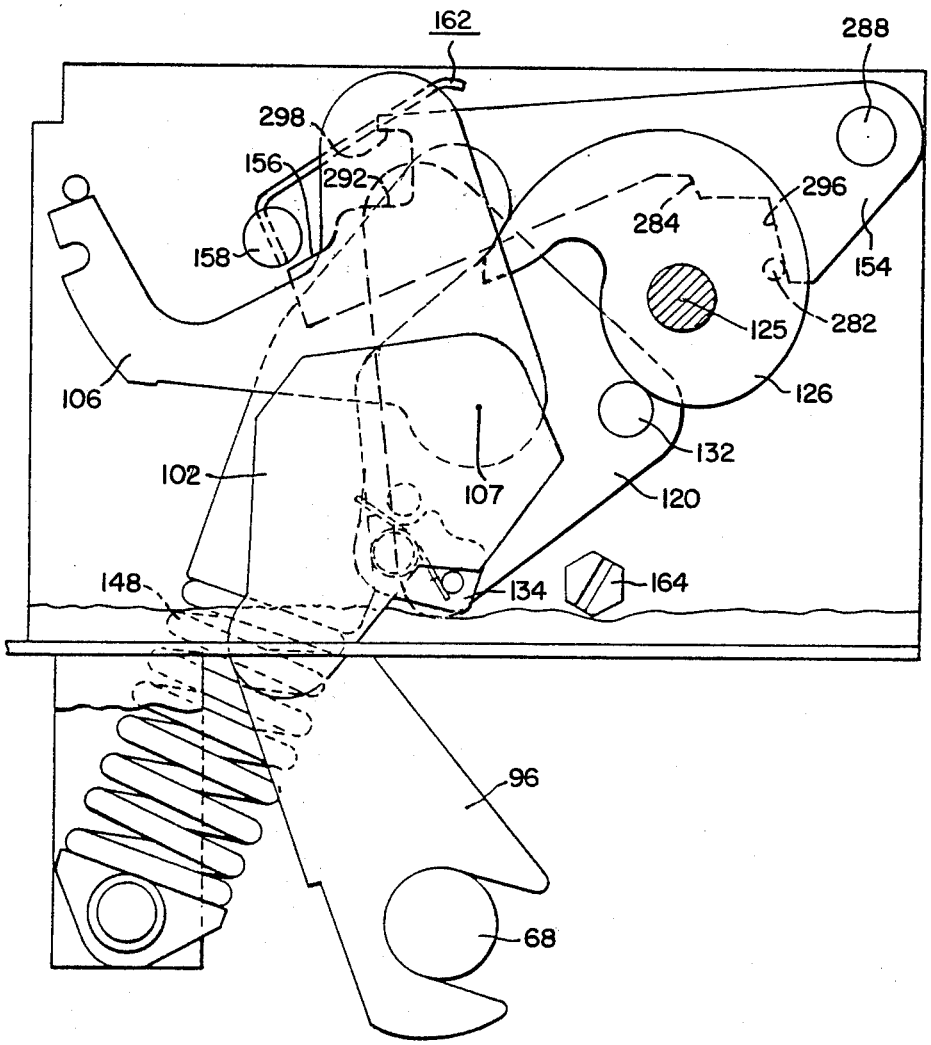
FIG. 5 is a modification of a view of FIG. 4 with the spring partially charged and the contact in the open position.

To begin, the drive shaft 124 is rotated in the clockwise direction by the turning means 129. As the drive shaft 124 rotates, the cam roller 132 which is engaged therewith, is pushed outwardly a distance equivalent to the increased diameter portion of the cam. FIG. 5 illustrates the position of the elements once the cam 126 has rotated about its axis 125 about 90° from its initial starting position. As can be seen, the cam roller 132 has moved outwardly with respect to its initial position. This movement of the cam roller 132 has caused a rotation of the follower plate 120 about its axis 107, and this rotation has stretched the spring 148 to partially charge it. Also to be noted is that the drive pawl 134 has likewise rotated along with the follower plate 120. (The preceding, and all subsequent descriptions of the movements of the various components will be made with respect to only those elements viewed in elevation. Most of the components incorporated within the circuit breaker preferably have corresponding, identical elements on the opposite side of the breaker. It is to be understood that although these descriptions will not mention these corresponding components, they behave in a manner similar to that herein described, unless otherwise indicated.)

Figure 6:
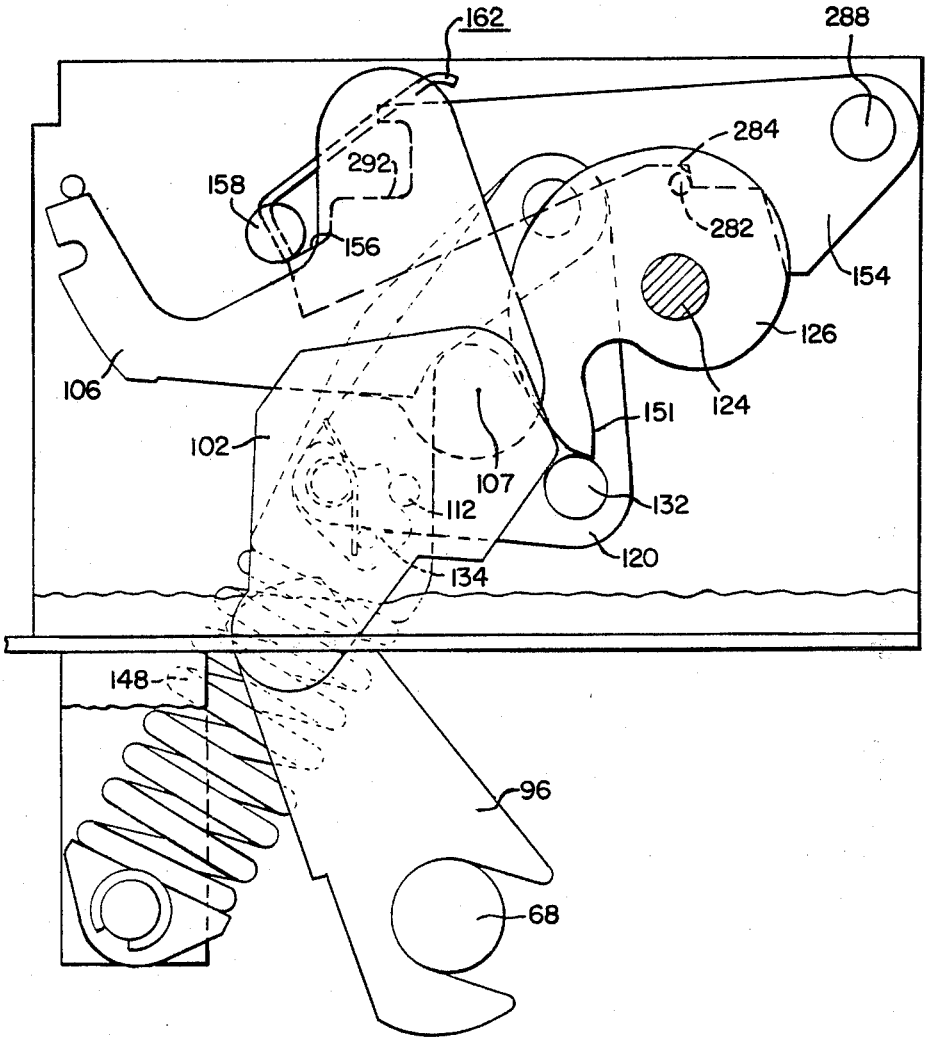
FIG. 6 is a modification of the views illustrated in FIGS. 4 and 5 with the spring charged and the contact open.

FIG. 6 illustrates the position of the components once the cam 126 has further rotated. The cam roller 132 has come into contact with flat surface 153 of cam 126. The follower plate 120 has rotated about its axis 107 to its furthest extent, and the spring 148 is totally charged. The drive pawl 134 has moved to its position adjacent to the drive pin 112. The latch member 154, at a flat surface 156 thereof has rotated underneath the curved portion of a D-latch 158. The tensioning of the spring 148 causes the cam roller 132 to exert a force against the latching surface 153 of cam 126, which would result in a clockwise rotation of the cam 126. However, the cam pin 282 has contacted the angled surface 284 of the latch member 154 and, since the surface 284 is in the path of movement of the cam pin 282 as it would travel during clockwise rotation of the cam 126, the cam 126 is prevented from rotating. The breaker 10 is thus latched with the spring 148 in the charged position. Therefore, so long as the surface 284 of the latch member 154 remains in this path, the cam roller 132 and the follower plate 120 fixedly secured thereto cannot have counterclockwise.

Figure 7:
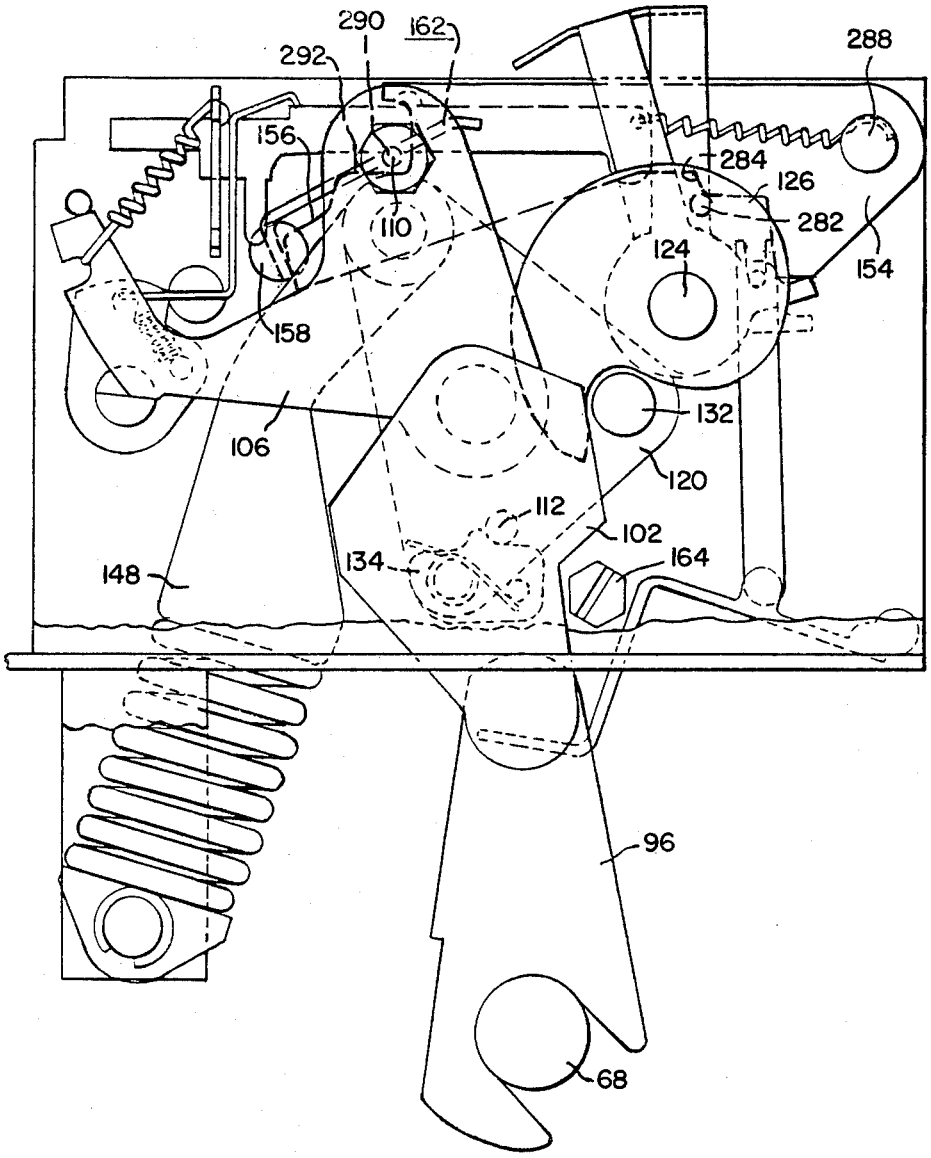
FIG. 7 is a modification of the view of FIGS. 4, 5, and 6 in the spring discharged, contact closed position.

The latch member 154 is held in its position in the path of the cam pin 282 by the action of the second surface 156 against the D-latch 158. The force of the cam pin 282 is exerted against the surface 284 and, if not for the D-latch 158, would cause the latch member 154 to rotate in the clockwise direction to release the pin 282 and discharge the spring 148. Therefore, the D-latch 158 prevents the surface 156 from moving in a clockwise direction which would thereby move the surface 284 out of the path of movement of the cam pin 282. To release the latch member 154, the releasable release means 162 are depressed, which causes a clockwise rotation of D-latch 158. The clockwise movement of the D-latch 158 disengages from the second surface 156 of the latch member 154, and the latch member 154 is permitted to rotate clockwise until the limit pin 290 strikes the outer surface 292 of the indented portion 294 of latch member 154, resulting in the movement of the first suface 284 away from the path of the cam pin 282. The results of such release is illustrated in FIG. 7.

Once the latch member 154 is released, the angled surface 284 of the latch member 154 is moved out of the path of the cam pin 282, thus permitting the cam 126 to rotate clockwise to allow the spring 148 to discharge, causing rotation of the follower plate 120 about its pivot axis 107. The rotation of the follower plate 120 moves the cam roller 132 into its position at the smallest diameter portion of the cam 126. At the same time, the rotation of the follower plate 120 causes the drive pawl 134 to push against the drive pin 112. This pushing against the drive pin 112 causes the drive pin 112, and the second link element 102 to which it is connected to move to the right as illustrated in the drawing. This movement causes the second link element 102 and the first link element 96, to move into toggle position with toggle lever element 106. This movement into the toggle position causes movement of the cross arm 68, which compresses the shoulder 84 of the pusher rod 78 against the spring 88, (see FIG. 2) and moves the movable contacts 26 into the closed position in electrical contact with the stationary contact 22. The movable contact 26 will remain in the closed position because of the toggle position of the toggle means 34. Once the toggle means 34 are in toggle position, they will remain there until the toggle lever 94 is released. As can be noticed from the illustration, the drive pawl 134 is now in its original position but adjacent to the drive pin 112. The first link 90 and the second link 92 are limited in their movement as they move into toggle position by the limiting bolt 164. This bolt 164 prevents the two links 90, 92 from knuckling over backwards and moving out of toggle position. (Throughout this application, the term "toggle position" refers to not only that position, when the first and second links are in precise alignment, but also includes the position when they are slightly over-toggled.) The status of the breaker at this position is that the spring 148 is discharged, and the contacts 26 are closed.

Figure 8:
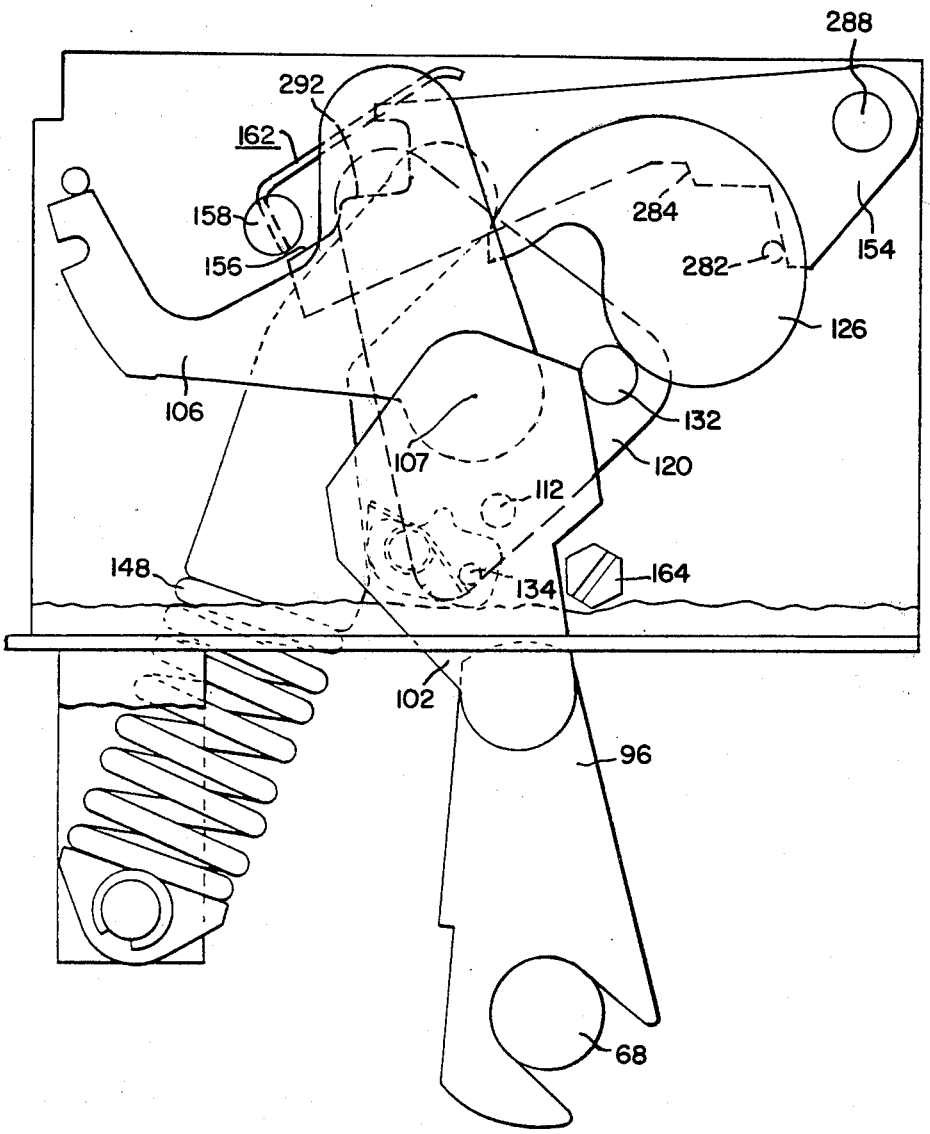
FIG. 8 is a modification of the view of FIGS. 4, 5, 6, and 7 with the spring partially charged and the contact closed.

FIG. 8 then illustrates that the spring 148 can be charged while the contacts 26 are closed, to thereby store energy to provide an open-close-open series. FIG. 8 is similar to FIG. 5, in that the cam 126 has been rotated about 90°, and the follower plate 120 has rotated about its pivot point 107 to partially charge the spring 148. Again, the drive pawl 134 has rotated with the follower plate 120. Note that the cam pin 282 has rotated and moved against reset surface 296 of latch member 154. By contacting the reset surface 296, the pin 282 has caused a counterclockwise rotation of the latch member 154 to cause it to move the latch surface 156 against the D-latch 158, thus resetting the latch member 154. Counterclockwise rotation of the latch member 154 is limited by limit pin 290, which strikes the surface 298 of the latch member 154 and prevents excessive counterclockwise rotation.

Figure 9:
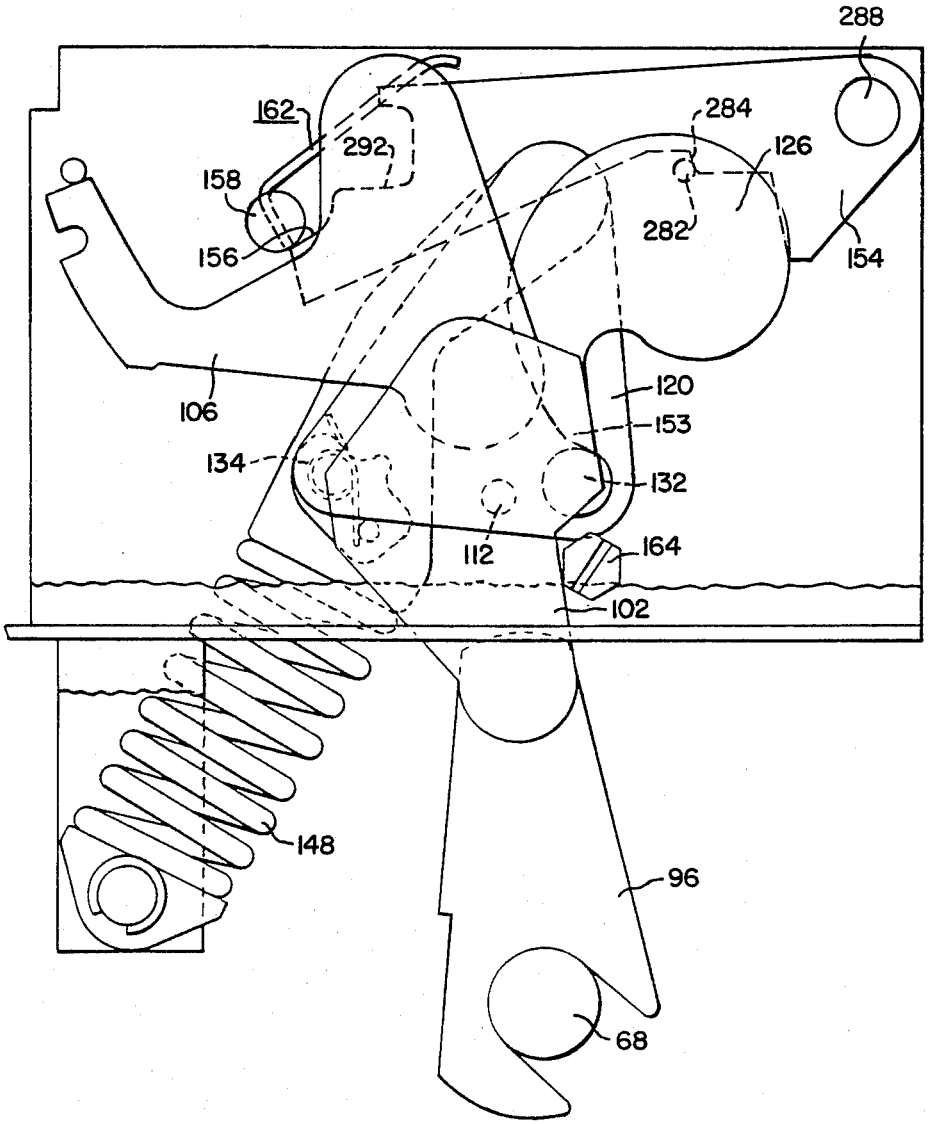
FIG. 9 is a modification of the view of FIGS. 4, 5, 6, 7, and 8 with the spring charged and contact closed.

FIG. 9 illustrates the situation wherein the spring 148 is totally charged and the contacts 26 are closed. The drive pawl 134 is in the same position it occupied in FIG. 6, except that the drive pin 112 is no longer contacted with it. The latch member 154 and more particularly the surface 284, is in the path of the cam pin 282 to thereby prevent rotation of the follower plate 120. The second surface 156 is held in its location by the D-latch 158 are previously described. In this position, it can be illustrated that the mechanism is capable of open-close-open series. Upon release of the toggle latch release means 166, the toggle lever 94 will no longer be kept in toggle position with links 90 and 92, but will instead move slightly in the counterclockwise direction. Upon counterclockwise movement of the toggle lever 94, the second link 92 will move in the clockwise direction, pivoting about the connection with the toggle lever 94, and the first link 90 will move in the counterclockwise direction with the second link 92. Upon so moving out of toggle, the force on the cross arm 68 which pushed the pusher rod 78 against the spring 88 will be released, and the release of the spring 88 will force the cross arm 68 and the movable contacts 26 into the open position. This then is the position of the components as illustrated in FIG. 6. To them immediately close the contacts 26, the latch member 154 is released, which as previously described, causes rotation of the follower plate 120 such that the drive pawl 134 contacts the drive pin 112 to cause movement of the drive pin 112 and the second link element 102 to which it is fixedly secured to move back into toggle position. This then results in the position of the components as illustrated in FIG. 7. The breaker 10 then can immediately be opened again by releasing the toggle latch release means 166, which will position the components to the position illustrated in FIG. 4. Thus it can be seen that the mechanism permits a rapid open-close-open series.

The toggle latch release means 166 are illustrated in FIGS. 3 and 4. The toggle latch release means 166 are comprised of the latch member release lever 168, the two D-latches 170 and 172, the catch 174, biasing springs 176 and 178 and the stop pin 180. To release the toggle means 34, the latch member release lever 168 is depressed. The depressing of this lever 168 causes a clockwise rotation of the D-latch 170. The catch 174 which had been resting on the D-latch 170 but was biased for clockwise rotation by the spring 176 is then permitted to move clockwise. The clockwise movement of the catch 174 causes a corresponding clockwise movement of the D-latch 172 to whose shaft 179 the catch 174 is fixedly secured. The clockwise movement on the D-latch 172 causes the latch lever 94, and more particularly the flat surface 182 upon which the D-latch 172 originally rested, to move, such that the surface 184 is now resting upon the D-latch 172. This then allows the toggle lever 94 to move in a counterclockwise direction, thereby releasing the toggle of the toggle means 34. After the toggle means 34 have been released, and the movable contact 26 positioned in the open position, the biasing spring 178 returns the toggle lever 94 to its position wherein the surface 182 is 94 resting upon the D-latch 172. To prevent the toggle lever 94 from moving too far in the clockwise direction, the stop pin 180 is utilized to stop the toggle lever 94 at its correct location.

As can be seen in FIG. 3, the D-latches 170 and 158 are attached to two levers each. Levers 183 and 190 are secured to D-latch 158, and levers 168 and 192 are secured to D-latch 170. The extra levers 190 and 192, are present to permit electromechanical or remote tripping of the breaker and spring discharge. An electromechanical flux transfer shunt trip 192 (see FIG. 3) may be secured to the frame 194 and connected to the current transformer 38 so that, upon the occurrence of an overcurrent condition, the flux transfer shunt trip 192 will move lever 192 in the clockwise direction to provide release of the toggle lever 94 and opening of the contacts 26. An electrical solenoid device may be positioned on the frame 194 adjacent to lever 190 so that the remote pushing of a switch (not shown) will cause rotation of lever 190 causing rotation of D-latch 158 and discharging of the spring 148 to thereby close the breaker.

Accordingly, the device of the present invention achieves certain new and novel advantages resulting in a compact and more efficient circuit breaker. The operating mechanism can be charged while the breaker is in operation and is capable of a rapid open-close-open sequence.

We claim as our invention:

1. A circuit breaker comprising:

a stationary contact;

a movable contact operable between open and closed positions with respect to said stationary contact;

movement effecting means for effecting relative movement of said movable contact between said open and closed positions, said movement effecting means including a rotatable cam having a cam pin fixedly secured thereto and extending outwardly therefrom; and releasable latch means for controlling closing operation of said movement effecting means, said latch means contacting said cam pin and preventing closing operation of said movement effecting means until said latch means are released;

said cam pin capable of contacting said latch means at a second location thereof to set said latch means in the latching position.

2. A circuit breaker as claimed in claim 1 wherein said movement effecting means include closing-spring means, said latch means latching said closing-spring means in the charged position.

3. A circuit breaker as claimed in claim 1 wherein said latch means comprises:

a pivotally mounted latch member having a first surface thereof capable of being disposed in the path of movement of said cam pin as said cam pin moves during the closing operation of said movement effecting means to prevent closing movement of said movement effecting means; and releasable latch member release means for pivotally moving said latch member first surface out of said cam pin movement path, to thereby permit closing operation of said movement effecting means.

4. A circuit breaker comprising:

a stationary contact;

a movable contact operable between open and closed positions with respect to said stationary contact;

movement effecting means for effecting relative movement of said movable contact between said open and closed positions, said movement effecting means comprising a rotatable cam having a cam pin fixedly secured thereto and extending outwardly therefrom, a cam follower member, closing-spring means operatively connected to said follower member, and drive means for moving said cam such that movement of said cam moves said follower member to charge said closing-spring means; and releasable latch means for controlling closing operation of said movement effecting means, said latch means contacting said cam pin and preventing closing operation of said movement effecting means until said latch means are released;

said cam holding said follower member in said closing-spring means charged position until said latch means are released.

5. A circuit breaker as claimed in claim 4, wherein said follower member exerts a rotational force on said cam, and said latch means prevents said cam from rotating until released.

* * * * *